United States Patent [19]

Rubey et al.

[11] Patent Number: 4,487,519

[45] Date of Patent: Dec. 11, 1984

[54] APPARATUS FOR PRINTING ON RECEIPT FORMS OR THE LIKE

[75] Inventors: Wolfgang Rubey; Günter Baitz; Wolfgang Malke; Harald Noack, all of Berlin, Fed. Rep. of Germany

[73] Assignee: Nixdorf Computer AG, Fed. Rep. of Germany

[21] Appl. No.: 430,544

[22] Filed: Sep. 30, 1982

[30] Foreign Application Priority Data

Nov. 30, 1981 [DE] Fed. Rep. of Germany ..... 3147415

[51] Int. Cl.[3] ..... B41J 13/22

[52] U.S. Cl. ..... 400/534; 400/622

[58] Field of Search ..... 400/531-535, 400/622-623

[56] References Cited

U.S. PATENT DOCUMENTS

| | | | |
|---|---|---|---|
| 1,625,321 | 4/1927 | Kurowski | 400/534 |
| 2,361,003 | 10/1944 | Anderson | 400/535 |
| 2,820,539 | 1/1958 | Raak | 400/535 |
| 3,208,575 | 9/1965 | Emig | 400/531 |
| 3,389,658 | 6/1968 | Matthew | 400/531 |
| 3,426,356 | 2/1969 | Zolliker | 400/534 |
| 3,912,068 | 10/1975 | Kwan et al. | 400/56 |
| 3,991,875 | 11/1976 | Zambolin et al. | 400/531 |
| 4,181,443 | 1/1980 | Hirabayashi et al. | 400/322 |

FOREIGN PATENT DOCUMENTS

| | | | |
|---|---|---|---|
| 3117165 | 1/1982 | Fed. Rep. of Germany | 400/531 |
| 2370596 | 7/1978 | France | 400/622 |

OTHER PUBLICATIONS

Hamilton, "Stencil Card Holder", IBM Technical Disclosure Bulletin vol. 1, No. 5, p. 3, 2/59.

*Primary Examiner*—William Pieprz
*Attorney, Agent, or Firm*—Krass & Young

[57] ABSTRACT

The invention relates to an apparatus for printing on receipt forms or the like with a one-line printing mechanism. In order also to be able to print the form with a number of lines, this is gripped firmly on a sliding carriage and the carriage is moved along into different line positions on the printing mechanism. A mechanical control mechanism with a cam plate serves for driving the sliding carriage. The closed cam plate makes possible a control in the retraction and extension direction with a corresponding rotation of the cam plate. The exact positioning of the sliding carriage is done by a ratchet in the control mechanism. An electronic control takes care of an automatic running of one printing operation.

5 Claims, 4 Drawing Figures

APPARATUS FOR PRINTING ON RECEIPT FORMS OR THE LIKE

DESCRIPTION

INTRODUCTION

The invention relates to an apparatus for receiving, holding and bidirectionally feeding documents relative to a printer mechanism.

BACKGROUND OF THE INVENTION

Such apparatus for example serve for providing forms with a very definite format, for example Eurochecks, with certain definite printed entries. The form is generally pushed into the receptacle by hand until it comes to lie against a stop; in this way it is ensured that the form is always printed exactly in the lines provided, which are determined by the stop. It must however be considered a disadvantage of the previously known apparatus that these can print only one line at a time.

In one known apparatus of the same class, the stop is indeed adjustable, i.e. the apparatus can be fitted to another line height by a more or less expensive conversion operation (DPR502N of the TEC firm). But this construction too permits only a one-line printing. If a series of forms are to be printed on in a number of lines, then the forms must run through the printer one by one a number of times; before each new run the printer must be converted, which is very expensive.

Since the forms are laid in the known apparatus by hand and taken out again by hand, they can respectively be pushed into the receptacle only far enough that an edge sufficient for grasping shows. Thereby a part of the form in the upper region is lost as a surface to be printed on, so that the apparatus is not usable at all for certain forms.

A further disadvantage of the known apparatus is seen in that no adequate guiding and holding of the form is offered, since the latter lies only loosely against the bottom stop or lateral stop surfaces. In particular, with forms having a width less than that provided for, the guiding is so poor that in the printing operation, especially in off-center printing, the danger of being askew exists.

BRIEF SUMMARY OF THE INVENTION

It is the problem of the invention to improve an apparatus of a type belonging to this class by simple means in such a way that it permits printing a number of lines, even with a one-line printing mechanism, and such that a printing of the top region of the form is also possible, and such that the form regardless of its format can be held and guided precisely during the printing operation.

This problem is solved according to the invention through the provision of a simple and inexpensive apparatus which is capable of receiving documents and moving documents securely through a reciprocal field of motion including a drawing-in motion and retracting or backing-out motion, one of which motions may be continuous and the other of which may be line-by-line, both of said motions being accomplished by a undirectional power source so that no motor reversing functions are necessary. In addition, the invention provides for the automatic clamping of the document into the apparatus as the initial motion begins and for the automatic releasing of the document as the motion ends.

The form, after having been laid in the receptacle is grasped by the feed apparatus and pushed into the different line positions one after another. During the drawing in and pushing out the form is held fast by the feed apparatus so that it cannot shift even during its printing or positioning. This holds true even when the form has a slightly smaller width than the width set by any side guides which may be present.

The control of the feed apparatus is effected by a mechanical control mechanism, i.e., forcibly therefore, so that the lines provided by the construction or layout of the apparatus are always reproduced exactly on any form.

The construction according to the invention also makes possible printing the top region of the form, since this can be inserted as far as desired into the receptacle. After the printing operation the form in any case is brought back into its starting position, where it can easily be grasped and removed by hand.

According to one feature of the invention the feed apparatus is constructed as a sliding carriage which is mounted movable in the housing and involves a reciprocally oscillating swing drive. The form is gripped tightly on this sliding carriage in a suitable manner to be described further in detail below and moves with it. It has been found that this construction of the feed apparatus is superior to the roll feeds generally known in printing technology. Superior as regards the guiding of the form. In particular there is no kind of askew pulling and no slippage. Besides this, the typical danger for roll feeds of abrasion of the rolls and faulty operation caused by this is avoided.

In a preferred development of the invention it is provided that the swing drive shows at least one oscillating toothed segment which engages in at least one rack formed on the sliding carriage. In order to exclude any tilting of the sliding carriage and ensure an absolutely parallel guiding, two racks running parallel to one another are preferably provided to which is assigned one toothed segment each. In a further development of the invention it is provided that the sliding carriage is provided with at least one leaf spring lying against the contact surface of the carriage as a gripping means for the form and that on the leaf spring a lifting pin is arranged which extends through a bore running from the back side of the rack through into the toothed region in a tooth space and which is moved by one tooth of the toothed segment into the position corresponding to the starting position of the sliding carriage in the direction of a lifting of the spring. When the form, after the printing operation, has again been pushed back into its starting position, the gripping is released in this manner and the form is released for removal.

The control mechanism according to the invention includes a cam plate with a closed, approximately heart-shaped cam curve, where a control pin connected with a rocking lever engages in the cam and the rocking lever is fastened to a swinging shaft which is connected with the swing drive of the feed apparatus. The cam curve according to the invention shows two separate regions, namely a first region corresponding to the retraction motion of the sliding carriage and a second one corresponding to the outward extension motion of the sliding carriage, which proceed one after the other in any printing operation. During the retracting motion the cam rotates continuously until the sliding carriage has reached its lower, fully retracted position. The extension motion, however, takes place discontinuously from line to line and back until it is in the starting position. As has already been mentioned above, in this position one tooth of the toothed segment presses on the lifting pin and in this way releases the gripping means, so that the form can be taken out and a new one inserted.

In order to grip the new form, the lifting pin must again be released. For this purpose it is provided according to the invention that the swinging shaft which carries the toothed segment is mounted so as to be movable longitudinally and that the cam carries a disk cooperating with the end of the swinging shaft at the cam side, which, at least at the start of the first region of the cam, pushes this in such a way that the toothed segment releases the lifting pin of the leaf spring. Only after the release of the lifting pin does the retraction motion of the sliding carriage occur.

The control mechanism, according to one feature of the invention, includes a clutch unit by way of which the control mechanism can be coupled with the existing motor drive of the printer. In this manner any separate drive for the sliding carriage can be eliminated. The clutch arrangement is preferably designed as a wrap spring clutch. This is very simple in construction and therefore inexpensive. A magnetic switch or the like is used for actuating the clutch unit.

According to a further feature of the invention, the control mechanism shows a ratchet catch where the stops respectively correspond to definite line positions of the feed apparatus or of the form. The pawl of the ratchet can also be actuated by the magnetic switch in such a way that when the gear unit is engaged the pawl is disengaged. By the actuation of the magnetic switch, therefore, the ratchet is released and the clutch is engaged both at the same time, so that the control mechanism and the sliding carriage operationally connected with it execute the motion provided for. By inactivation of the magnetic switch the clutch is released and by the catching of the pawl the control mechanism is stopped precisely in one of the line positions provided for.

For the control of the motor drive as well as of the magnetic switch, an electronic control unit is provided, which in turn is controllable by the signal generator.

One embodiment example of the invention is represented in the drawings and described in more detail in the following.

DETAILED DESCRIPTION OF THE SPECIFIC EMBODIMENTS

Figure 1:
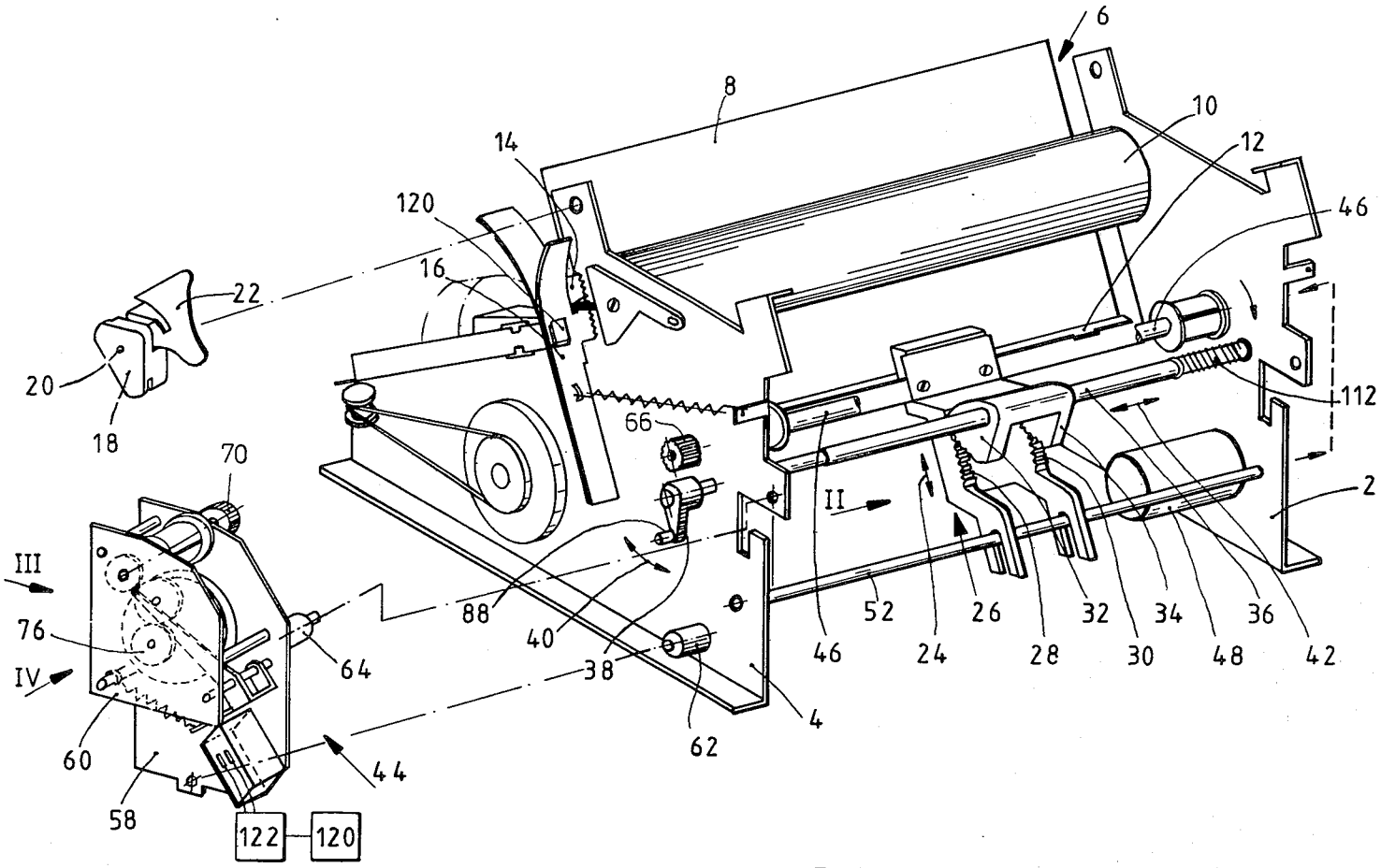
FIG. 1 shows an exploded representation of a printer with feed apparatus and control mechanism.

The printer represented in FIG. 1 has a substantially conventional basic construction. The form receptacle 6 is located between two lateral frame walls 2 and 4. In the present case this is essentially formed by a back wall 8 and the platen 10. The form lies with its side to be printed against the back wall 8, which in the region of the platen 10 has suitable apertures for the penetration of the printing mechanism, which is not shown in detail here. For a more accurate adjustment of the lines of the form a stop 12 is used, on which the check rests. This stop 12 can be adjusted for height by means of a catch device 14 so that different line heights can be set. This adjustment of the stop 12 need not be described in detail here; but it may be noted that the operation is bothersome, since the cover of the apparatus, not represented in detail here, must be removed. Guide plates 16 serve to facilitate the insertion of the form in the receptacle 6. Swiveling stops 18 may be fastened onto the side faces 2 and 4, only one of which stops is represented. These enclose guide plates 22 rotatable respectively around a shaft 20, which in their swiveled-in position laterally close off the receptacle 6, while in the position represented, however, these are left open to receive wider forms.

A sliding carriage 26 mounted to be movable in the direction of the arrow 24 extends by its upper end into the region of the receptacle 6. A gripping means described more accurately below grasps the check, so that it moves this with the sliding carriage 26. The sliding carriage 26 is driven by way of two racks 28, 30 formed on the latter in which engage toothed segments 32, 34 mounted in rocking form. These toothed segments are fastened onto a swinging shaft 36 which is rotatable in the side walls 2 and 4 and is driven by way of a rocking lever 38 in rocking motion according to the arrow 40. The swinging shaft 36 is also movable lengthwise in the direction of the arrow 42, so that the toothed segments 32, 34 are moved laterally in their assigned racks 28, 30, with which however these always remain in engagement. The rocking lever 38 is driven by means of the mechanical control mechanism 44, which in turn is connected with the drive 48 by way of the driving shaft 46.

Figure 2:
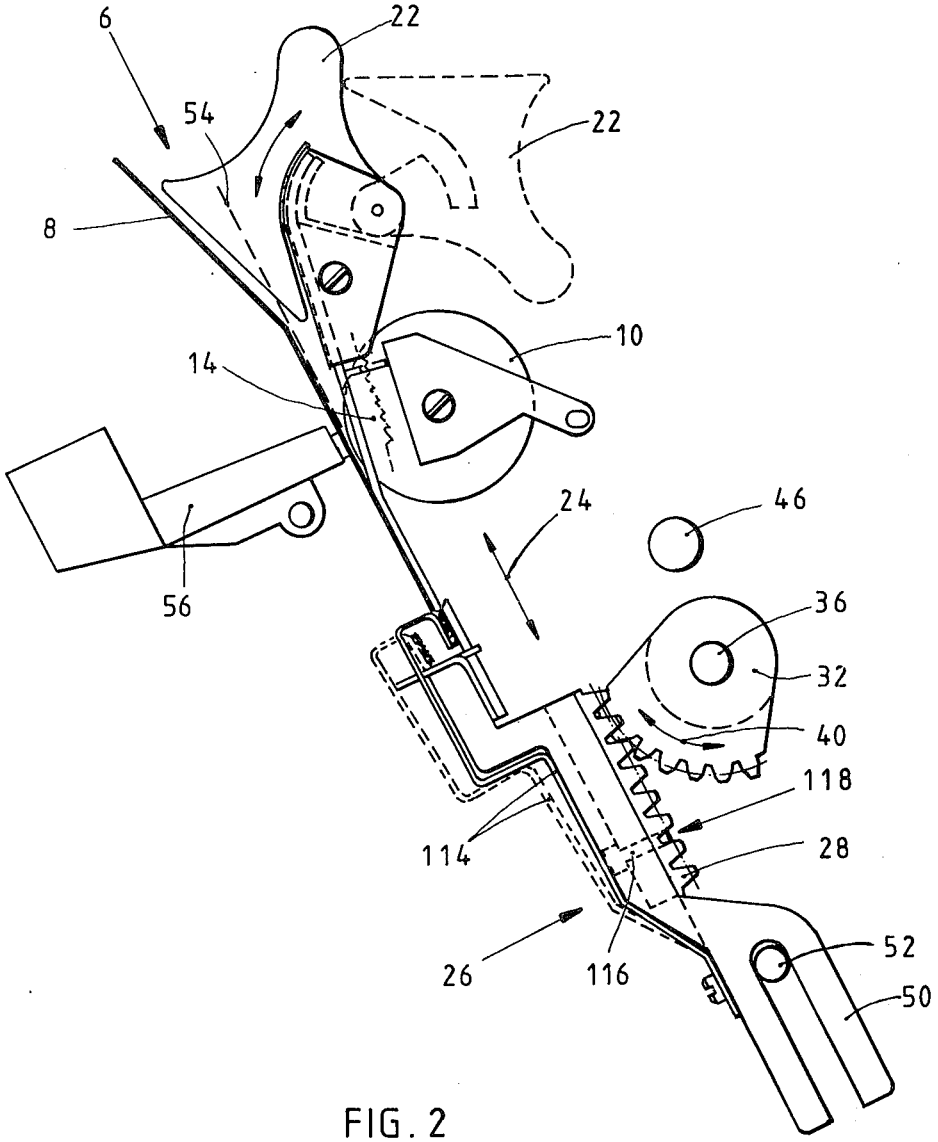
FIG. 2 shows a side view of the feed apparatus in the direction of the arrow II in FIG. 1.

FIG. 2 in an enlarged representation shows the sliding carriage 26, which is mounted movably in the direction of the arrow 24 in a conventional manner which therefore is not represented in detail. The forks 50, only one of which is represented in FIG. 2, are moved on a connecting rod 52. The sliding carriage 26 is assuming its lower position in FIG. 2 in which the form 54 represented by a broken line is drawn entirely into the receptacle, so that the printing mechanism 56 can print the topmost line. The form has standard dimensions, so that the guide plate 22 can be swiveled into its folded-down position, closing off the receptacle 6 laterally. When the toothed segments 32 and 34 are swung back, the sliding carriage 26 is moved upward, carrying the form 54 with it. It is basically possible for the form to be first entirely drawn into the receptacle and to be printed line by line while being pushed outward.

Figure 3:
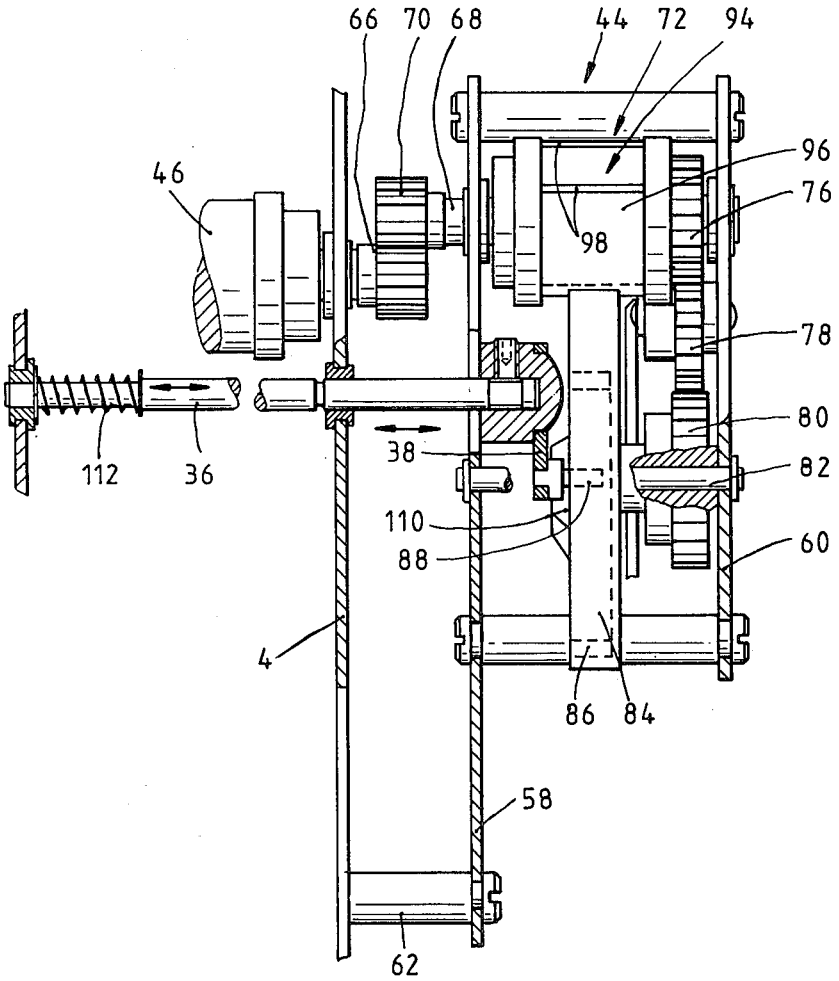
FIG. 3 shows a partly cutaway view of the control mechanism in the direction of the arrow III of FIG. 1.
Figure 4:
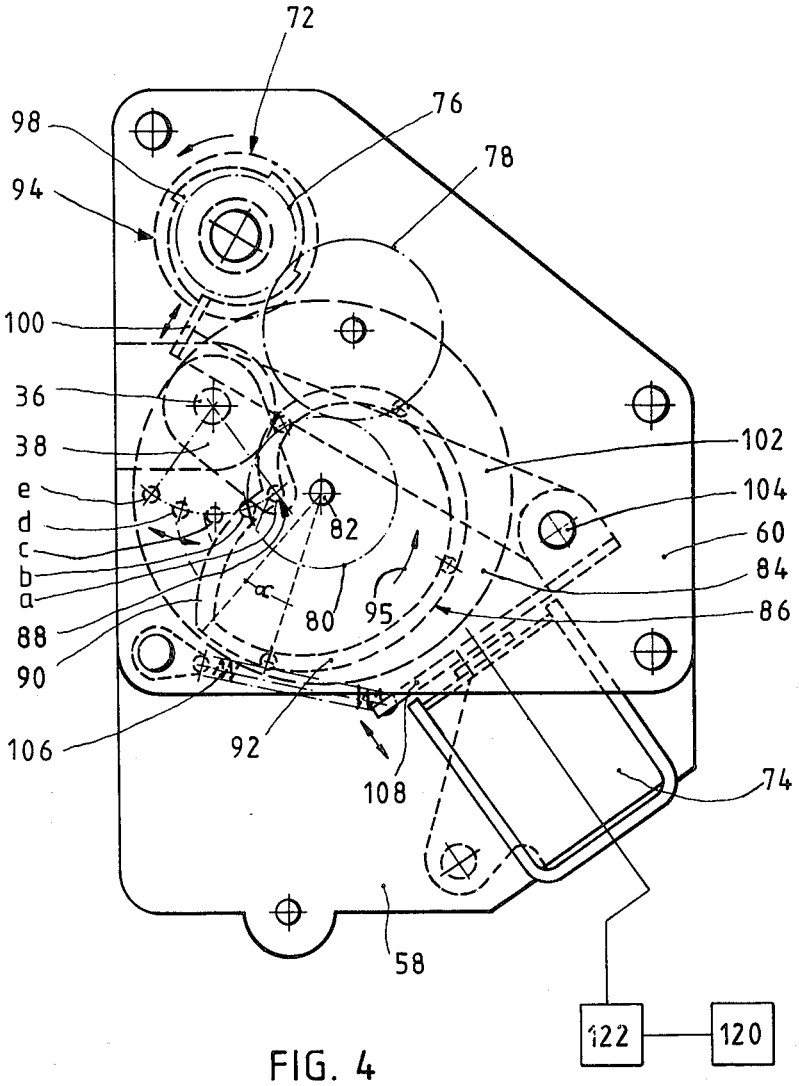
FIG. 4 shows the control mechanism according to FIG. 3 in a side view in the direction of the arrow IV in FIG. 1.

The construction of the control mechanism 44 is seen from FIGS. 3 and 4. The whole mechanism, accommodated between two frame walls 58, 60, is fastened onto the side wall 4 by means of spacer bolts 62, 64. A gear 70 joined with a clutch shaft 68 engages in the pinion gear 66 joined with the driving shaft 46. On the clutch shaft 68 is arranged a wrap spring clutch 72 which is actuatable by a magnetic switch 74. By means of the wrap spring clutch 72, the clutch shaft 68 can be coupled with the gear 76 which transmits its rotary motion through an intermediate gear 78 to a further gear 80 which in turn is fastened to the camshaft 82. The camshaft 82 carries the cam 84 which is provided with a closed cam curve 86 which is approximately heart-shaped. A control pin 88 connected with the rocking lever 38 engages in the cam curve 86. As is shown particularly in FIG. 4, the cam curve 86 shows a first region 90 which corresponds to the continuous retracting motion of the sliding carriage 26, as well as a second region 92 which corresponds to the line by line extension motion of the carriage as well as of the form associated with it. When the cam plate 84 rotates in the direction of the arrow 95 in FIG. 4, the control pin 88 passes through the region 92. Starting with the position a, it then successively assumes the positions b, c, d and e. Each of these positions corresponds to one line of type. Position e at the same time corresponds to the starting position of the sliding carriage, in which the form is removed and a new one can be laid in it. With the further rotation of the cam plate 84 in the same rotation direction, the control pin passes through the region 90 where the rocking lever 38 is again swung back into position a and thus the form is drawn in completely.

In order to ensure an exact line positioning of the cam 84 as well as of the sliding carriage 26 connected with it, a ratchet 94 is provided. A locking toothing 98 is formed on a part 96 connected with the driven part of the wrap spring clutch 72, in which toothing a pawl 100 can engage. The pawl 100 is rotatable by means of a lever 102 around a shaft 104, and is held in the engaged position by a spring 106 which acts on a lever 108 connected with with the lever 102 as in FIG. 4. The pawl 100 can be disengaged by the magnetic switch 74 against the force of the spring 106, so that the part 96 can execute a rotary motion.

The wrap spring clutch 72 and also the pawl 100 are actuated simultaneously by the magnet switch 74 in such a way that when the clutch is engaged the pawl is disengaged. The wrap spring clutch has a $4\times90°$ catch division; a further shifting by 90° respectively corresponds to a movement of the rocking lever 38 from one position to the next one, so that after one cycle of the part 96 one has passed through the positions from a to e. Retracting the sliding carriage accordingly required a further 90° shifting motion of the part 96.

As FIG. 3 in particular shows, on the side of the cam 84 turned toward the swinging shaft 36 there is arranged a disk 110 which cooperates with the end of the the swinging shaft 36 or with the rocking lever 38 fastened onto the latter and cap-shaped in design. In this way, when the control pin 88 runs through the region designated as $\alpha$ in FIG. 4, the swinging shaft 36 is moved against the force of the pressure spring 112. The region $\alpha$ is distinguished in that here the cam curve runs concentrically to the camshaft 82, so that the rocking lever 38 makes no motion but rather remains in the position corresponding to position e. As can be seen from FIG. 2, a gripping means formed by one or more leaf springs 114 bent at right angles is arranged on the carriage 26. These lie spring-loaded against the sliding carriage and serve for retaining the form 54. On each leaf spring is fastened a lifting pin 116 which extends through a bore running through the racks 28, 30 into a tooth space 118. When the toothed segments 32, 34 move the sliding carriage 26 upward out of the lower position represented in FIG. 2, one tooth of the toothed segment reaches the corresponding tooth space 118 and forces the lifting pin 116 downward so that the leaf springs 114 are moved into the lifted position represented in broken lines. In this position the gripping means is released, so that a form 54 can be taken out or laid in. By means of the subsequent shifting motion of the swinging shaft 36 as described above the toothed segments are moved so far to the side that they release the lifting pins 116 and the leaf springs 114 because of their inherent spring force again assume their gripping position, so that the form 54 is held fast. During this shifting motion of the toothed segments 32, 34 the sliding carriage 26 still makes no motion, since the control pin 88 is passing through the concentric region $\alpha$ of the cam, as was described above. At the end of the region $\alpha$ the disk 110 is again out of engagement with the rocking lever 38, and the swinging shaft 36 as well as the toothed segments 32, 34 arranged on it again assume their normal position under the action of the pressure spring 112. With a further rotation of the cam plate 84 the control pin 88 then passes through the region 90 following the region $\alpha$ on the cam curve, so that the rocking lever 38 in FIG. 4 swings to the right and the sliding carriage 26 executes its retraction motion from position e to position a. Then in turn follows the line by line extension motion of the sliding carriage corresponding to the region 92 of the cam curve 86, with a release of the gripping at the end of this motion, as has been further described above, so that the apparatus is ready for another printing sequence.

The whole apparatus is controlled in this way, that a signal generator 120, for example a mechanical sensor or a photoelectric device indicates that a form has been laid in and delivers an appropriate start signal. An electronic control unit 122 controls the printing cycle by repeated energizing of the drive 48 as well of the magnetic switch 74 which in turn actuates the wrap spring clutch 72 as well as the ratchet 94. As FIG. 1 shows, the signal generator 120 can be arranged on one of the guide plates 16 and for example can be designed as a photoelectric device.

We claim:

1. Apparatus for receiving, holding and bidirectionally feeding documents relative to a printer, comprising:

slide means mounted for directional lineal motion relative to the printer; said slide means having a rack portion thereon;

document-clamping means on said slide means for receiving, clamping and releasing documents therein; said document-clamping means comprising a rigid clamp portion which engages the documents and a resilient spring arm which carries the rigid clamp portion;

rotatable power means;

gear means having teeth mechanically engaging the rack portion of said slide means and rotatable in one direction to advance the slide means from an initial position to a drawn-in position and in the other direction to return the slide means to the initial position;

the document-clamping means including a pin mounted in said rack portion for displacement at right angles thereto and bearing against the spring arm and being arranged to be displaced by the engagement of a tooth of said gear means with said pin to release documents at one of said positions and to grip documents at other positions;

and drive means mechanically interconnecting said power means with said gear means for converting rotation of said drive means into bidirectional rotation of said gear means.

2. Apparatus as defined in claim 1 wherein said slide means comprises a pair of fork-shaped elements each having gear tooth racks formed thereon.

3. Apparatus as defined in claim 2 wherein said gear means comprises at least two toothed sectors mounted to be driven on a common shaft, said toothed sectors engaging said racks.

4. Apparatus as defined in claim 1 wherein said drive means comprises a cam disk having a closed, approximately heart-shaped control curve, a control pin connected with a rocking lever and engaging said control curve, said rocking lever being mounted on a swing axle on which is mounted said gear means.

5. Apparatus as defined in claim 4 wherein said control curve exhibits a first range corresponding to a drawing-in movement and a second range corresponding to a retracting or feeding out movement.

* * * * *